US010434787B2

(12) United States Patent
Shimizu

(10) Patent No.: US 10,434,787 B2
(45) Date of Patent: Oct. 8, 2019

(54) PRINTER

(71) Applicant: BROTHER KOGYO KABUSHIKI KAISHA, Nagoya-shi, Aichi-ken (JP)

(72) Inventor: Seiji Shimizu, Ogaki (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 15/935,804

(22) Filed: Mar. 26, 2018

(65) Prior Publication Data

US 2018/0281434 A1 Oct. 4, 2018

(30) Foreign Application Priority Data

Mar. 28, 2017 (JP) ..... 2017-063011

(51) Int. Cl.

| | |
|---|---|
| ***B41J 2/175*** | (2006.01) |
| ***B41J 29/02*** | (2006.01) |
| ***B41J 29/13*** | (2006.01) |
| ***B41J 29/38*** | (2006.01) |

(52) U.S. Cl.

CPC ..... *B41J 2/17546* (2013.01); *B41J 2/175* (2013.01); *B41J 2/1752* (2013.01); *B41J 2/17506* (2013.01); *B41J 2/17509* (2013.01); *B41J 2/17513* (2013.01); *B41J 2/17566* (2013.01); *B41J 29/02* (2013.01); *B41J 29/13* (2013.01); *B41J 29/38* (2013.01); *B41J 2002/17573* (2013.01)

(58) Field of Classification Search

CPC .. B41J 2/17546; B41J 2/1752; B41J 2/17523; B41J 2/17566; B41J 2/17596

USPC ..... 347/6, 84–86

See application file for complete search history.

(56) References Cited

U.S. PATENT DOCUMENTS

| | | | | |
|---|---|---|---|---|
| 7,828,425 | B2 * | 11/2010 | Kang | B41J 2/17596 347/20 |
| 7,887,168 | B2 * | 2/2011 | Shimizu | B41J 2/1652 347/50 |
| 8,047,640 | B2 * | 11/2011 | Uchiyama | B41J 2/17509 347/6 |
| 9,085,166 | B1 | 7/2015 | Takagiwa | |

FOREIGN PATENT DOCUMENTS

| | | | |
|---|---|---|---|
| JP | 2002-046259 | A | 2/2002 |
| JP | 2004-168001 | A | 6/2004 |
| JP | 2007-216442 | A | 8/2007 |
| JP | 2012-171191 | A | 9/2012 |
| JP | 2013-176867 | A | 9/2013 |
| JP | 2014-188965 | A | 10/2014 |
| JP | 2014-195907 | A | 10/2014 |

(Continued)

OTHER PUBLICATIONS

Notification of Reasons for Rejection issued in related Japanese Patent Application No. 2017-063011, dated Mar. 5, 2019. (12 pages).

*Primary Examiner* — An H Do
(74) *Attorney, Agent, or Firm* — K&L Gates LLP

(57) ABSTRACT

A printer includes a head and a connector. The head is configured to eject ink. The connector is configured to connect a first storage to the head, and configured to connect a second storage to the head via a joint component. The first storage stores the ink. The second storage stores a greater amount of the ink than the first storage.

11 Claims, 10 Drawing Sheets

(56) References Cited

FOREIGN PATENT DOCUMENTS

| | | | |
|---|---|---|---|
| JP | 2015-196250 | A | 11/2015 |
| JP | 2017-024217 | A | 2/2017 |
| KR | 20050005590 | A | 1/2005 |

* cited by examiner

PRINTER

CROSS-REFERENCE TO RELATED APPLICATION

This application claims priority to Japanese Patent Application No. 2017-063011 filed on Mar. 28, 2017, the disclosure of which is herein incorporated by reference in its entirety.

BACKGROUND

The present disclosure relates to a printer.

A printer is known that can print a color image on a print medium by ejecting inks of five colors (white (W), black (K), yellow (Y), cyan (C) and magenta (M)). The inks of the respective colors are each stored in a liquid storage bag disposed inside a cartridge. The liquid storage bag is a flexible bag-shaped container. Further, an image forming device is known that performs printing using ink stored in a main tank.

SUMMARY

If an amount of ink stored inside the cartridge that has the above-described liquid storage bag is smaller than an amount of ink stored in a tank, such as the above-described main tank, a frequency of cartridge replacement becomes greater. As a result, there is a possibility that operation costs of the printer may increase. Meanwhile, an amount that can be stored in the tank is a large amount, and thus, compared to the cartridge, operation costs tend to be lower. However, when the ink is not used up within a consumption time limit, the ink is wasted and there is a possibility that costs to dispose of the ink may increase. In order to reduce operation costs and the costs of disposal of the ink, it is necessary to select the tank and the cartridge in accordance with a usage amount of the ink. However, with the known printer, it has not been possible to select the tank and the cartridge in accordance with the usage amount of the ink. There are thus cases in which usability of the printer has not been convenient for a user.

Various embodiments of the general principles described herein provide a printer that improves user convenience.

Embodiments herein provide a printer including a head and a connector. The head is configured to eject ink. The connector is configured to connect a first storage to the head, and configured to connect a second storage to the head via a joint component. The first storage stores the ink. The second storage stores a greater amount of the ink than the first storage.

BRIEF DESCRIPTION OF THE DRAWINGS

Embodiments will be described below in detail with reference to the accompanying drawings in which.

DETAILED DESCRIPTION

A printer 1 that is an embodiment of the present disclosure will be explained with reference to the drawings. An overview of a configuration of the printer 1 will be explained with reference to FIG. 1. In the following explanation, the upper side, the lower side, the lower right side, the upper left side, the upper right side and the lower left side of FIG. 1 are respectively defined as the upper side, the lower side, the right side, the left side, the rear side and the front side of the printer 1.

Figure 1:
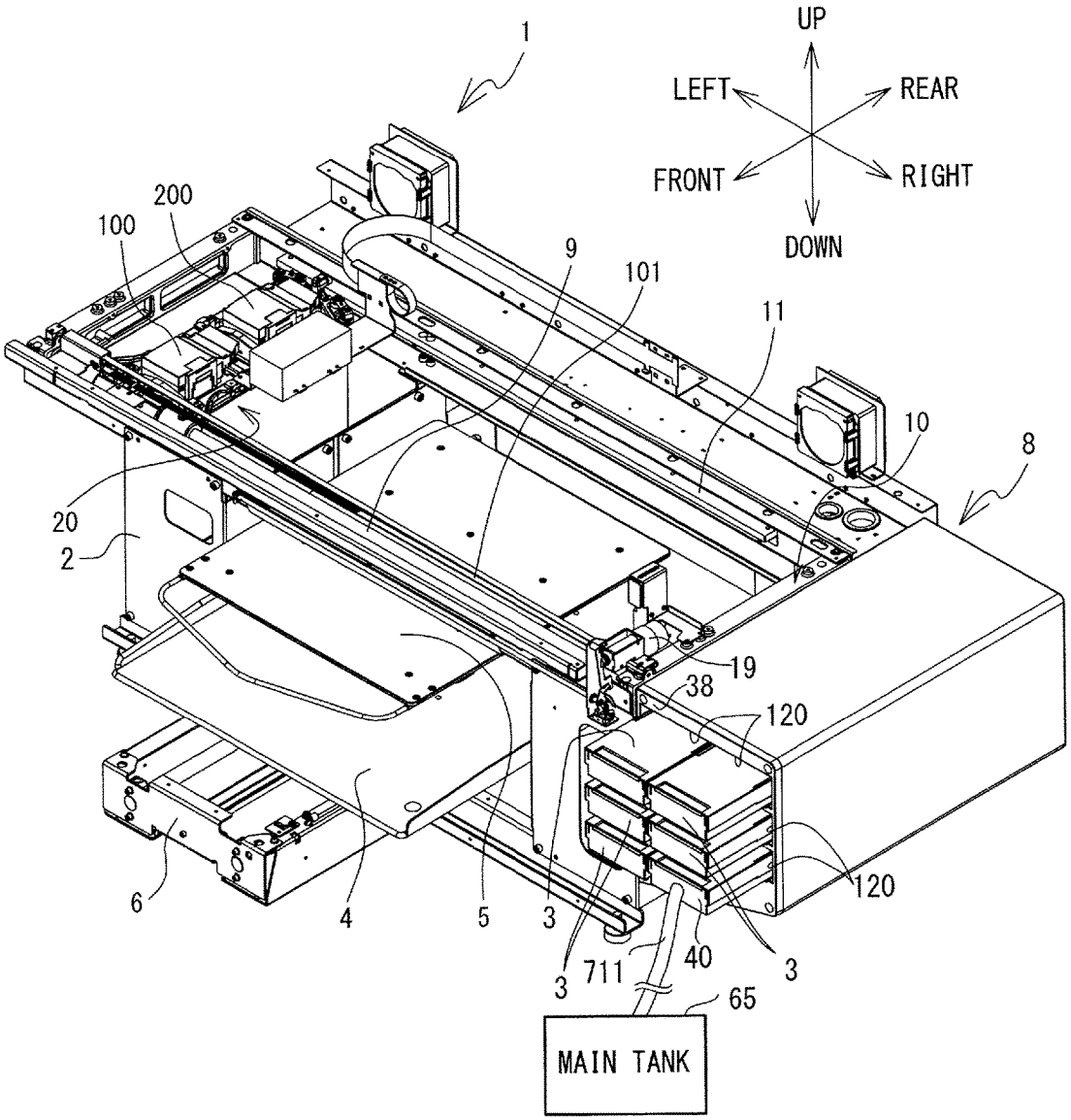
FIG. 1 is a perspective view of a printer.

As shown in FIG. 1, the printer 1 is an inkjet printer that performs printing by ejecting an ink that is a liquid onto a print medium, including a cloth such as a T shirt (not shown in the drawings), paper or the like. The printer 1 can print a color image on the print medium by downwardly ejecting inks of five mutually different colors (white (W), black (K), yellow (Y), cyan (C), and magenta (M)).

The printer 1 is provided with a housing 2, a platen drive mechanism 6, a platen 5, a tray 4, a frame body 10, a guide shaft 9, a rail 11, a carriage 20, head units 100 and 200, a drive belt 101, and a drive motor 19. The housing 2 is a substantially cuboid shape. An operation portion 79 (refer to FIG. 7) is provided on a front right side of the housing 2 and is used to operate the printer 1. The operation portion 79 is provided with a display 781 (refer to FIG. 7) and operation buttons (not shown in the drawings).

The platen drive mechanism 6 is driven by a motor (not shown in the drawings) that is provided on a rear end portion of the platen drive mechanism 6 and that is a power source of the platen drive mechanism 6. The platen drive mechanism 6 causes the platen 5 and the tray 4 to move along a pair of guide rails (not shown in the drawings) in the front-rear direction of the housing 2. The platen 5 is a plate that has a rectangular shape in a plan view. The print medium that is the cloth, such as the T shirt or the like, for example, is placed on the upper surface of the platen 5. The tray 4 has a substantially rectangular shape in a plan view and is provided below the platen 5.

The frame body 10 is a frame shape that has a substantially rectangular shape in a plan view, and is placed on an upper portion of the housing 2. The frame body 10 respectively supports the guide shaft 9 and the rail 11 on the inside of the frame body 10. The carriage 20 is supported such that the carriage 20 can be conveyed along the guide shaft 9 in the left-right direction. The head units 100 and 200 are mounted on the carriage 20. A head portion 67 (refer to FIG. 2 and FIG. 3) is provided on a lower surface of each of the head units 100 and 200. Each of the head portions 67 is provided with a plurality of minute nozzles and ejects droplets of an ink 68 (refer to FIG. 3 and FIG. 4) downward from the nozzles as a result of driving of piezoelectric elements.

The drive belt 101 is stretched along the left-right direction on the inside of the frame body 10. The drive motor 19 can rotate clockwise and counterclockwise, and is coupled to the carriage 20 via the drive belt 101. The printing is performed on the print medium by the printer 1 by ejecting the ink 68 from the head portion 67 that is reciprocating in the left-right direction (a sub scanning direction) due to the driving of the drive motor 19, while the platen 5 conveys the print medium in the front-rear direction (a conveyance direction).

A mounting portion 8 is provided on the right side of the printer 1. In the present embodiment, a cartridge 3 or a connection module 40 is connected to the mounting portion 8. The cartridge 3 is a cartridge that connects a liquid storage body 301 (refer to FIG. 4 and FIG. 5), which is housed inside the cartridge 3, to the head portion 67 (refer to FIG. 2) of the printer 1, via flow paths 720 and 721 to be described later. The liquid storage body 301 houses the ink 68 (refer to FIG. 4 and FIG. 5).

The connection module 40 is a joint component for connecting a main tank 65 (refer to FIG. 3) provided on the outside of the printer 1 and the connection module 40 to the head portion 67 (refer to FIG. 3) of the printer 1. The main tank 65 can store a larger amount of the ink 68 than the liquid storage body 301 (refer to FIG. 4).

The ink 68 is supplied to the head portion 67 of each of the head units 100 and 200 via the cartridge 3 or the connection module 40 mounted in the mounting portion 8. More specifically, the ink 68 stored in the liquid storage body 301 or the main tank 65 is filled into a sub pouch 97 (refer to FIG. 2 and FIG. 3) to be described later, and is supplied to the head portion 67 from the sub pouch 97.

A total number of the cartridges 3 and the connection modules 40 that can be mounted in the mounting portion 8 is six. Note that, in FIG. 1, one of the connection modules 40 is mounted in the mounting portion 8, but more than one of the connection modules 40 may be mounted in the mounting portion 8.

Placement portions 120 are provided in the mounting portion 8, with three rows of the placement portions 120 in the up-down direction, and two rows of the placement portions 120 in the left-right direction. Each of the six placement portions 120 has substantially the same configuration. Configurations of the placement portion 120, the cartridge 3, and the connection module 40 will be described in detail later.

Figure 2:
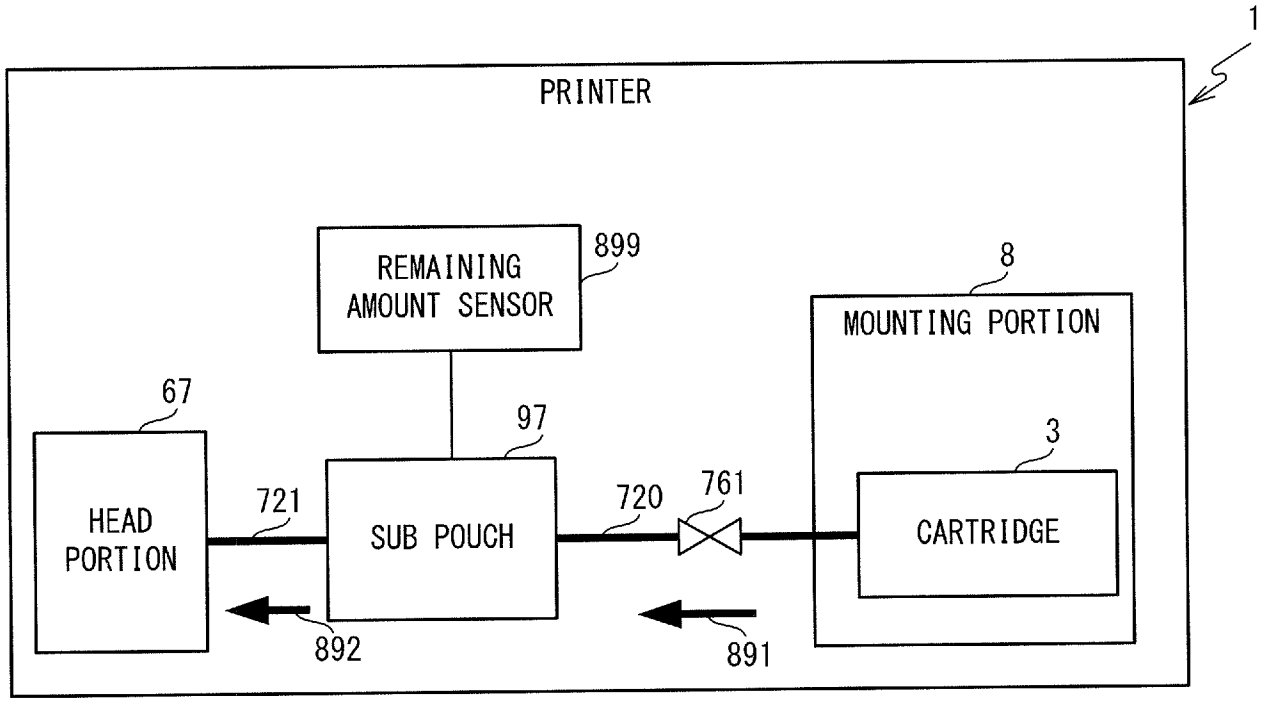
FIG. 2 is a diagram of flow paths of ink from a cartridge to a head portion.

Flow paths of the ink 68 when the cartridge 3 is mounted in the mounting portion 8 will be explained with reference to FIG. 2. FIG. 2 shows an example of flow paths along which the ink 68 of one color flows. Flow paths along which the inks 68 of the other four colors flow from the cartridge 3 are the same as in FIG. 2.

As shown in FIG. 2, the printer 1 is provided with the sub pouch 97, the flow path 720, the flow path 721, an electromagnetic valve 761, and a remaining amount sensor 899. The flow paths 720 and 721 are, for example, formed by hollow tubes, and the ink 68 flows through the inside of the tubes.

The cartridge 3 mounted in the mounting portion 8 is connected to the sub pouch 97 via the flow path 720. The electromagnetic valve 761 is provided in the flow path 720. The electromagnetic valve 761 opens and closes the flow path 720 in accordance with the control of a CPU 70.

The sub pouch 97 is bag shaped and stores the ink 68 supplied from the main tank 65 or the liquid storage body 301. The sub pouch 97 is connected to the head portion 67 via the flow path 721. The sub pouch 97 supplies the ink 68 to the head portion 67 via the flow path 721. The head portion 67 ejects the ink 68 supplied from the sub pouch 97 and performs printing on the print medium.

The remaining amount sensor 899 is mounted in the sub pouch 97. The remaining amount sensor 899 outputs a signal, to the CPU 70 (refer to FIG. 7), indicating a remaining amount of the ink 68 stored in the sub pouch 97. On the basis of the signal outputted by the remaining amount sensor 899, the CPU 70 detects the remaining amount of the ink 68 in the sub pouch 97. The remaining amount sensor 899 may be provided with a similar configuration to a remaining amount sensor 661 (refer to FIG. 7) to be described later.

Figure 3:
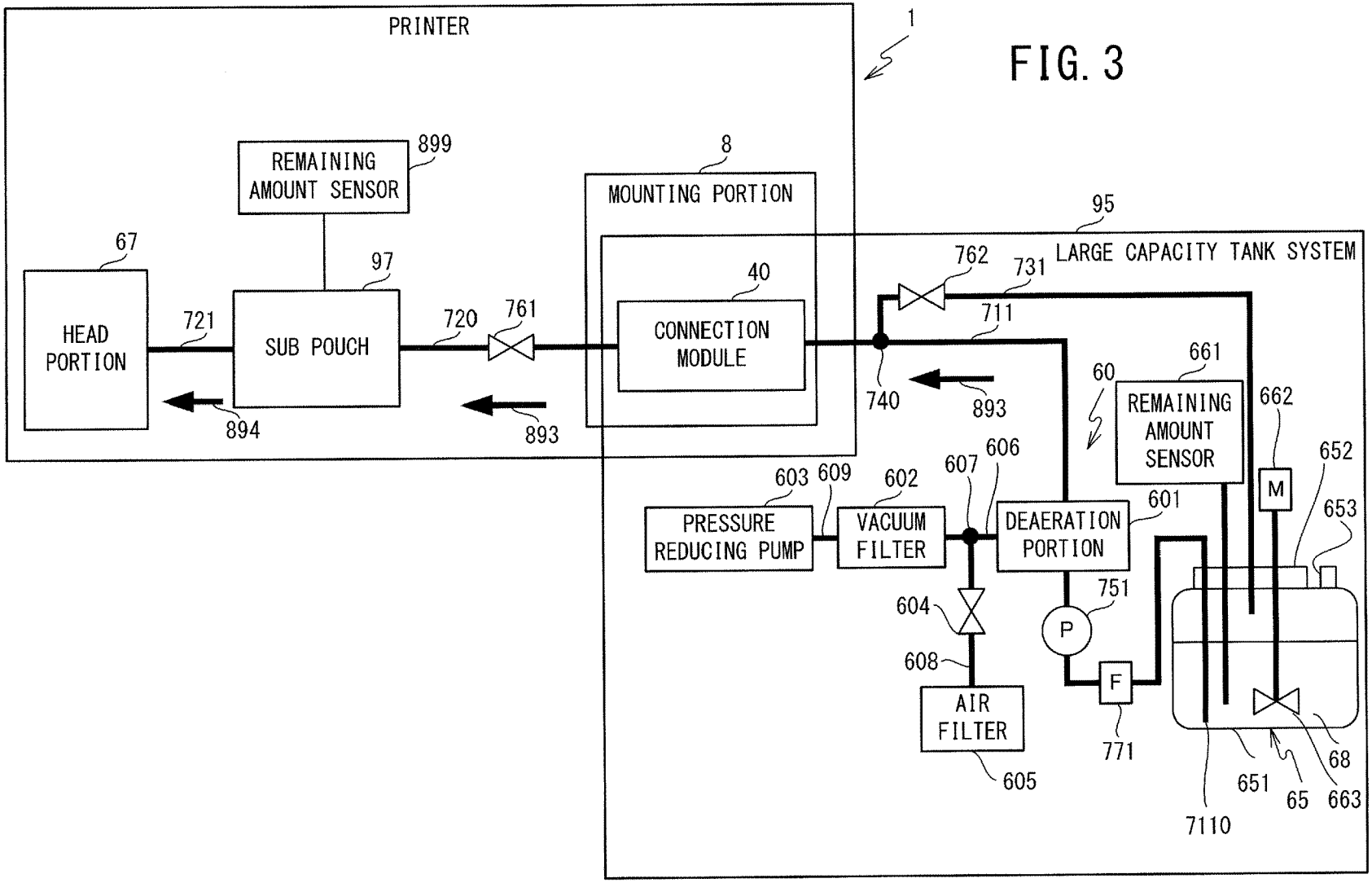
FIG. 3 is a diagram showing flow paths of ink from a main tank to the head portion.

Flow paths of the ink 68 when the connection module 40 is mounted in the mounting portion 8 will be explained with reference to FIG. 3. FIG. 3 shows an example of flow paths along which the ink 68 of one color flows. The flow paths along which the other four color inks 68 flow via the connection module 40 are the same as in FIG. 3.

As shown in FIG. 3, by mounting the connection module 40 in the mounting portion 8, a large capacity tank system 95 is mounted in the printer 1. The large capacity tank system 95 is provided with the main tank 65, the connection module 40, the remaining amount sensor 661, a motor 662, a supply flow path 711, a circulation flow path 731, an electromagnetic valve 762, a filter 771, a pump 751, and a deaeration module 60.

The main tank 65 stores the ink 68. An amount that can be stored in the main tank 65 is greater than an amount that can be stored in a sub pouch 97. The main tank 65 is provided with a container 651, and a lid 652 and 653. The container 651 is a member that stores the ink 68. A container opening and a lid opening, which are open portions, are provided in the upper portion of the container 651. The container opening is closed by the lid 652. The lid opening is closed by a lid 653. When the main tank 65 is replenished with the ink 68, the lid 653 is opened and the ink 68 is supplied into the container 651 from the lid opening.

The remaining amount sensor 661 is mounted on the main tank 65. The remaining amount sensor 661 outputs, to the CPU 70, a signal indicating a remaining amount of the ink 68 stored in the main tank 65. On the basis of the signal outputted by the remaining amount sensor 661, the CPU 70 detects the remaining amount of the ink 68 in the main tank 65. The remaining amount sensor 661 may be provided with electrodes that pass through the lid 652, or may be an optical sensor that has a light emitting portion provided on the outside of the container 651.

The rotating portion 663 is provided inside the container 651. The rotating portion 663 is provided in a position such that the rotating portion 663 can be disposed in the ink 68 inside the container 651. The motor 662 rotates the rotating portion 663 in accordance with the control of the CPU 70. When the rotating portion 663 rotates, the ink 68 stored in the main tank 65 is agitated. In this way, it is possible to reduce the possibility of sedimentation of the components of the ink 68 in the main tank 65.

The supply flow path 711 and the circulation flow path 731 are, for example, formed by hollow tubes. The supply flow path 711 extends from the main tank 65 toward the inside of the connection module 40. An end portion 7110 of the supply flow path 711 on the main tank 65 side is provided in a position such that the end portion 7110 can be disposed inside the liquid of the ink 68 stored in the main tank 65.

The circulation flow path 731 is connected to the supply flow path 711 at a connection point 740. The circulation flow path 731 extends from the connection point 740 toward the main tank 65. The circulation flow path 731 is a flow path that circulates the ink 68 stored in the main tank 65.

The electromagnetic valve 762 is provided in the circulation flow path 731. The electromagnetic valve 762 opens and closes the circulation flow path 731 in accordance with the control of the CPU 70.

The filter 771 is provided in the supply flow path 711. The filter 771 eliminates foreign matter included in the ink 68 that flows through the supply flow path 711.

The pump 751 is provided in the supply flow path 711. The pump 751 is provided in the supply flow path 711 between the main tank 65 and the connection module 40. More specifically, the pump 751 is provided between the filter 771 and a deaeration portion 601 to be described later. The pump 751 sucks up the ink 68 from the main tank 65 and causes the ink 68 to flow to the head portion 67 that is on the downstream side.

The deaeration module 60 is provided in the supply flow path 711. The deaeration module 60 is provided with the deaeration portion 601, a vacuum filter 602, a pressure reducing pump 603, an electromagnetic valve 604, an air filter 605, and channels 606, 608, and 609. The deaeration portion 601 is provided in the supply flow path 711, between the main tank 65 and the connection module 40. More specifically, the deaeration portion 601 is provided between the pump 751 and the connection point 740.

The vacuum filter 602 is connected to the deaeration portion 601 via the channel 606. The channel 606 is connected to the channel 608 at a connection portion 607. The air filter 605 is connected to the channel 608. The electromagnetic valve 604 is provided in the channel 608. The pressure reducing pump 603 is connected to the vacuum filter 602 via the channel 609.

The pressure reducing pump 603 operates in accordance with the control of the CPU 70 and depressurizes the channel 606 via the vacuum filter 602. In this way, air bubbles included in the ink 68 flowing through the deaeration portion 601 decrease. When the channel 606 is depressurized, the electromagnetic valve 604 closes the channel 608 in accordance with the control of the CPU 70. When the channel 606 is not depressurized, the electromagnetic valve 604 opens the channel 608 in accordance with the control of the CPU 70. When the channel 608 is opened, atmospheric air is supplied to the channel 606 via the air filter 605 and the channel 606. In this way, the depressurized state of the channel 606 is released. The air filter 605 eliminates foreign matter from the atmospheric air flowing to the channel 608 side. Hereinafter, although not particularly referred to, it is assumed that when the ink 68 is flowing through the supply flow path 711, the air bubbles are eliminated, by the deaeration module 60, from the ink 68 flowing through the supply flow path 711.

Figure 4:
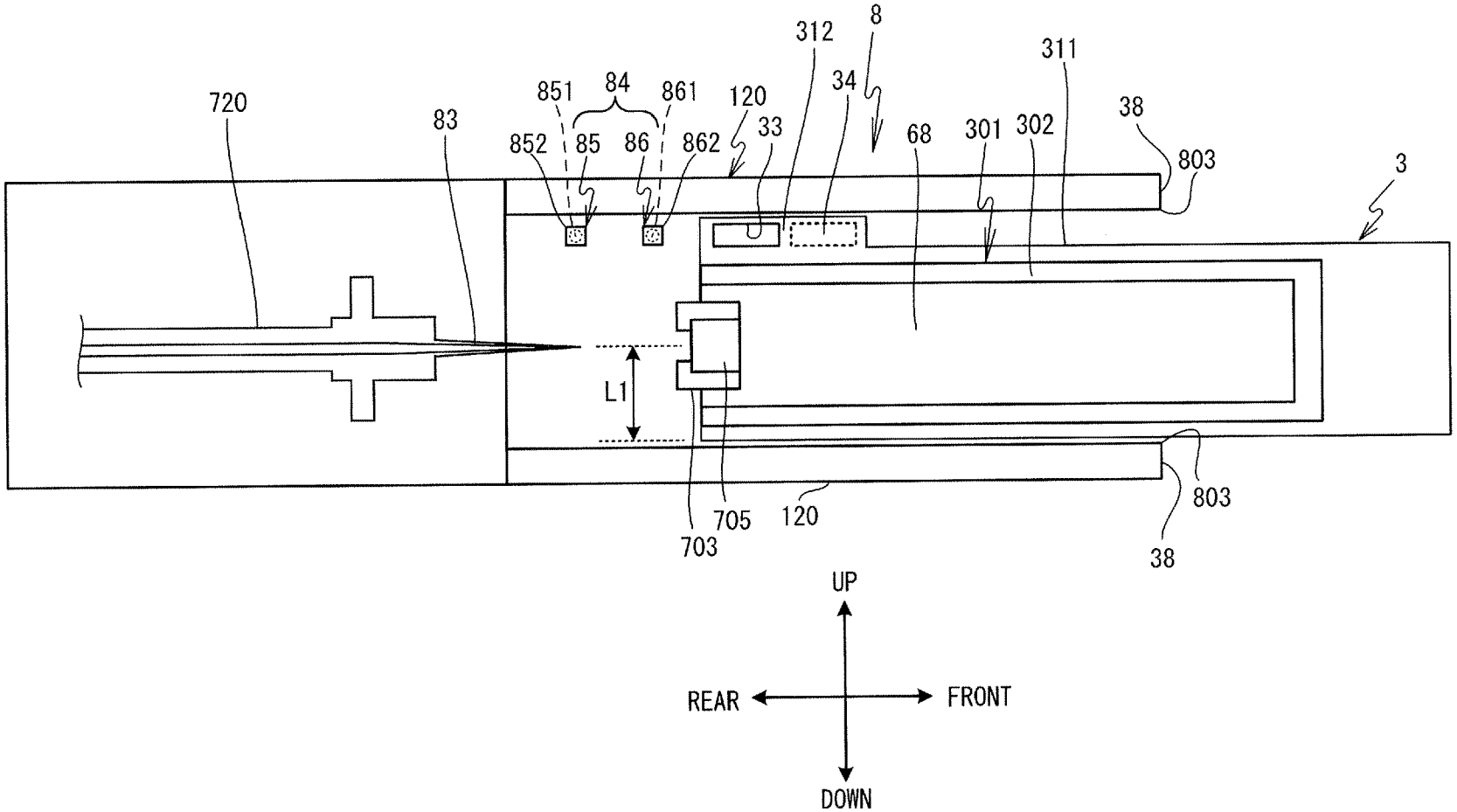
FIG. 4 is a longitudinal cross-sectional view showing a configuration of placement portions of a mounting portion and the cartridge.

The placement portions 120 of the mounting portion 8 will be explained in detail with reference to FIG. 4. Note that, FIG. 4 shows the configuration of one of the placement portions 120. The configuration of the other five placement portions 120 is the same as that shown in FIG. 4.

As shown in FIG. 4, the placement portion 120 is formed to be recessed toward the rear from a front surface 38 of the mounting portion 8. The end portion of the placement portion 120 on the front side is an opening 803, at which the front surface 38 of the mounting portion 8 is open, and which is rectangular in a front view. The cartridge 3 or the connection module 40 is removed from and inserted into the placement portion 120 via the opening 803.

A sensor portion 84 is provided on an upper rear portion of the placement portion 120. The sensor portion 84 includes a first optical sensor 85 and a second optical sensor 86. The second optical sensor 86 is disposed to the front of the first optical sensor 85. The first optical sensor 85 is provided with a light-emitting portion 851 and a light-receiving portion 852 that are provided facing each other in the left-right direction. The second optical sensor 86 is provided with a light-emitting portion 861 and a light-receiving portion 862 that are provided facing each other in the left-right direction. On the basis of outputs of the first optical sensor 85 and the second optical sensor 86, the CPU 70 detects the cartridge 3 or the connection module 40 arranged in the placement portion 120.

A needle 83 is disposed in the rear portion of the placement portion 120. The needle 83 is provided in a leading end of the flow path 720 (refer to FIG. 2 and FIG. 3) on the mounting portion 8 side. The needle 83 has a hollow shape, and the ink 68 flows through the interior of the needle 83. The needle 83 can connect the liquid storage body 301 of the cartridge 3 to the head portion 67 (refer to FIG. 2 and FIG. 5). Further, the needle 83 can connect the main tank 65 to the head portion 67 via the connection module 40 (refer to FIG. 3 and FIG. 6). A connection mode of the liquid storage body 301 and the main tank 65 using the needle 83 will be described later.

Figure 5:
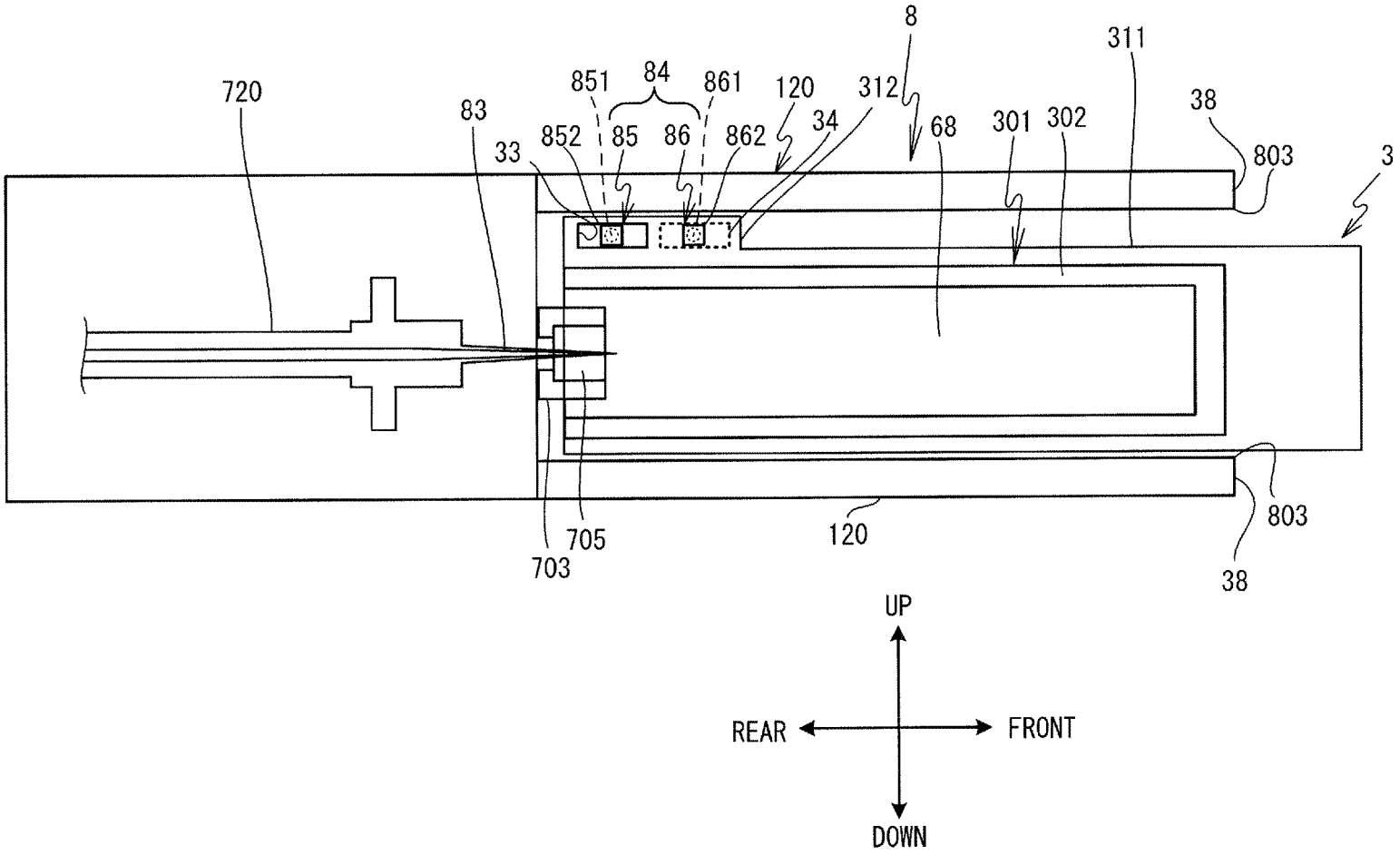
FIG. 5 is a longitudinal cross-sectional view showing a state in which the cartridge is connected to the mounting portion.

The cartridge 3 will be described with reference to FIG. 4 and FIG. 5. As shown in FIG. 4 and FIG. 5, the cartridge 3 is provided with the liquid storage body 301 and a case 311. The liquid storage body 301 is provided with a liquid storage bag 302, a stopper 703, and a rubber plug 705. The liquid storage bag 302 is a bag-shaped container. The liquid storage bag 302 is, for example, formed by overlapping two flexible sheets, which are made of a resin and have a rectangular shape, with each other in a state in which respective surfaces of the flexible sheets face each other, and connecting peripheral edge portions of the sheets by thermal welding or heat sealing. The liquid storage bag 302 extends in the front-rear direction. The ink 68 is stored inside the liquid storage bag 302.

The stopper 703 is provided in the rear end portion of the liquid storage bag 302. The stopper 703 has a cylindrical shape and extends in the front-rear direction. The rubber plug 705 is disposed on the inside of the stopper 703. The rubber plug 705 seals the stopper 703 such that the ink 68 inside the liquid storage bag 302 does not leak.

The case 311 has a box-shaped outer appearance that is long in the front-rear direction. The liquid storage bag 301 is housed inside the case 311. The rear end portion of the case 311 is open and exposes the stopper 703 and the rubber plug 705 to the rear side.

As shown in FIG. 5, when the cartridge 3 is mounted in the mounting portion 8, the needle 83 penetrates the rubber plug 705. The leading end of the needle 83 reaches the ink 68 stored in the liquid storage body 301. In this way, the ink 68 can be supplied to the head portion 67 side via the needle 83.

As shown in FIG. 4 and FIG. 5, a plate-shaped portion 312, which protrudes upward, is provided on an upper rear end portion of the case 311. The plate-shaped portion 312 extends in the front-rear direction. A first detection area 33 and a second detection area 34 are provided on the plate-shaped portion 312. The first detection area 33 is a rectangular-shaped opening provided in the plate-shaped portion 312. The second detection area 34 is provided to the front of the first detection area 33. The first detection area 33 has the rectangular-shaped opening provided in the plate-shaped portion 312, while the second detection area 34 does not have an opening.

As shown in FIG. 5, when the cartridge 3 is mounted in the mounting portion 8, the first detection area 33 is positioned between the light-emitting portion 851 and the light-receiving portion 852 of the first optical sensor 85, and the second detection area 34 is positioned between the light-emitting portion 861 and the light-receiving portion 862 of the second optical sensor 86. The first detection area 33 and the second detection area 34 are used by the sensor portion 84 to detect the cartridge 3 which will be described in detail later.

The connection module 40 will be explained with reference to FIG. 6. The connection module 40 is provided with a case 411 and a part of the supply flow path 711. The case 411 has a box-shaped outer appearance that is long in the front-rear direction. The case 411 has substantially the same outer appearance as the case 311 of the cartridge 3. In the present embodiment, the case 311 and the case 411 have the same dimensions in the up-down direction and the left-right direction. Thus, as described above, the case 311 and the case 411 can be inserted into and removed from the same placement portion 120. Note that, in the present embodiment, the dimensions of the case 311 and the case 411 in the front-rear direction are also the same.

A plate-shaped portion 412, which protrudes upward, is provided on an upper rear end portion of the case 411. The plate-shaped portion 412 extends in the front-rear direction. A first detection area 43 and a second detection area 44 are provided on the plate-shaped portion 412. The first detection area 33 (refer to FIG. 5) has the rectangular-shaped opening in the plate-shaped portion 312 (refer to FIG. 5), while the first detection area 43 does not have an opening in the plate-shaped portion 412. The second detection area 44 is provided to the front of the first detection area 43. Similarly to the first detection area 43, the second detection area 44 does not have an opening in the plate-shaped portion 412. When the connection module 40 is mounted in the mounting portion 8, the first detection area 43 is positioned between the light-emitting portion 851 and the light-receiving portion 852 of the first optical sensor 85, and the second detection area 44 is positioned between the light-emitting portion 861 and the light-receiving portion 862 of the second optical sensor 86. The first detection area 43 and the second detection area 44 are used by the sensor portion 84 to detect the connection module 40, which will be described in detail later.

An opening 442, which is open in the front-rear direction and has the circular shape, is provided in the front end portion of the case 411. The supply flow path 711 (refer to FIG. 3 and FIG. 6) passes through the inside of the opening 442 and enters inside the case 411.

The supply flow path 711 has a supply flow path 711A and a supply flow path 711B. The supply flow path 711A is provided on the inside of the case 411. The supply flow path 711A is disposed in the rear end portion of the case 411. The supply flow path 711A extends in the front-rear direction. The supply flow path 711A is provided with a stopper 713 and an extension portion 714. The stopper 713 is provided in the rear end portion of the case 411. The stopper 713 has a cylindrical shape and extends in the front-rear direction. A rubber plug 715 is disposed on the inside of the stopper 713. The rear end portion of the case 411 is open and exposes the stopper 713 and the rubber plug 715 to the rear side. The rubber plug 715 seals the stopper 713 such that the ink 68 inside the supply flow path 711 does not leak.

The extension portion 714 extends to the front from the front portion of the stopper 713. The extension portion 714 is a cylindrical shape and the ink 68 flows through the inside of the extension portion 714. The front end portion of the extension portion 714 is connected to the rear end portion of the supply flow path 711B.

The supply flow path 711B extends to the outside of the case 411 via the opening 442 provided in the front end portion of the case 411. The supply flow path 711B is formed by a member that is more flexible than the supply flow path 711A.

Figure 6:
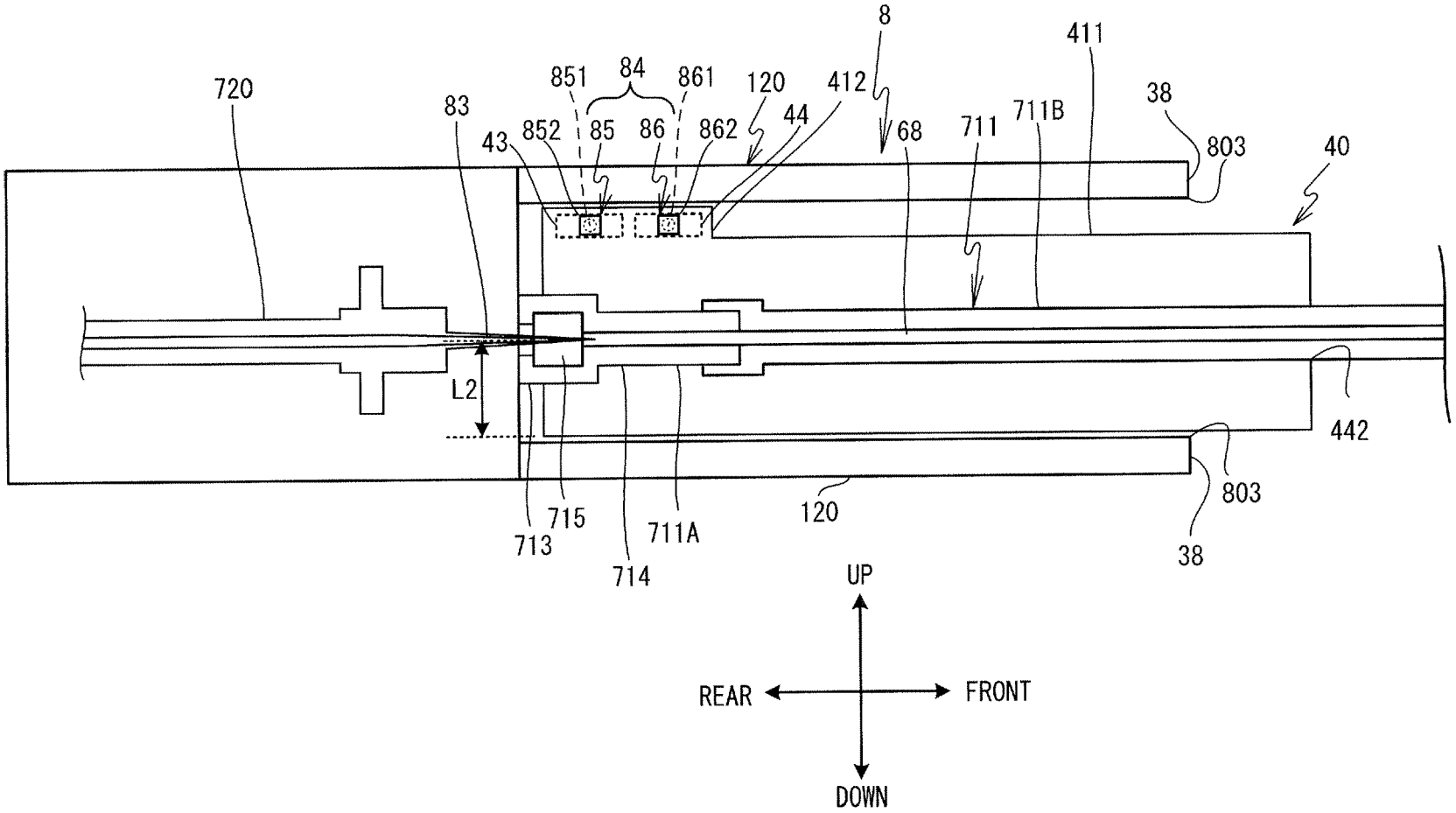
FIG. 6 is a longitudinal cross-sectional view showing a state in which a connection module is connected to the mounting portion.

As shown in FIG. 6, when the connection module 40 is mounted in the mounting portion 8, the needle 83 penetrates the rubber plug 715. The leading end of the needle 83 reaches the inside of the supply flow path 711A. In this way, the ink 68 flowing inside the supply flow path 711A can be supplied to the head portion 67 side.

A distance L2 (refer to FIG. 6) from the lower end of the case 411 of the connection module 40 to the center of the rubber plug 715 in the up-down direction is the same as a distance L1 (refer to FIG. 4) from the lower end of the case 311 of the cartridge 3 to the center of the rubber plug 705 in the up-down direction. Thus, in comparison to a case in which the distance L1 and the distance L2 are different, the needle 83 more reliably penetrates the rubber plug 705 or the rubber plug 715 when one of the cartridge 3 and the connection module 40 is mounted in the mounting portion 8.

A signal outputted from the sensor portion 84 will be explained. When the cartridge 3 or the connection module 40 is mounted in the mounting portion 8, the second optical sensor 86 outputs a connected signal, and when both the cartridge 3 and connection module 40 are not mounted in the mounting portion 8, the second optical sensor 86 outputs a disconnected signal. For example, as shown in FIG. 5 and FIG. 6, when the cartridge 3 or the connection module 40 is mounted in the mounting portion 8, the light emitted by the light-emitting portion 861 of the second optical sensor 86 is blocked by the second detection area 34 or the second detection area 44 and is not received by the receiving portion 862. Meanwhile, when both the cartridge 3 and the connection module 40 are not mounted in the mounting portion 8, the light emitted by the light-emitting portion 861 of the second optical sensor 86 is received by the light-receiving portion 862 (refer to FIG. 4). As a result, the second optical sensor 86 outputs a signal indicating that the light has not been received, as the connected signal, and outputs a signal indicating that the light has been received, as the disconnected signal.

The first optical sensor 85 of the sensor portion 84 outputs a first signal when the liquid storage body 301 is connected to the needle 83, and outputs a second signal when the main tank 65 is connected to the needle 83. For example, as shown in FIG. 5, when the cartridge 3 is mounted in the mounting portion 8 and the liquid storage body 301 is connected to the needle 83, the light emitted by the light-emitting portion 851 of the first optical sensor 85 is received by the light-receiving portion 852, via the first detection area 33. As shown in FIG. 6, when the connection module 40 is mounted in the mounting portion 8 and the main tank 65 is connected to the needle 83, the light emitted by the light-emitting portion 851 of the first optical sensor 85 is blocked by the first detection area 43 and is not received by the light-receiving portion 852. As a result, in a state in which the connected signal is outputted by the second optical sensor 86, the first optical sensor 85 outputs the signal indicating that the light has been received, as the first signal, and outputs the signal indicating that the light has not been received, as the second signal.

Figure 7:
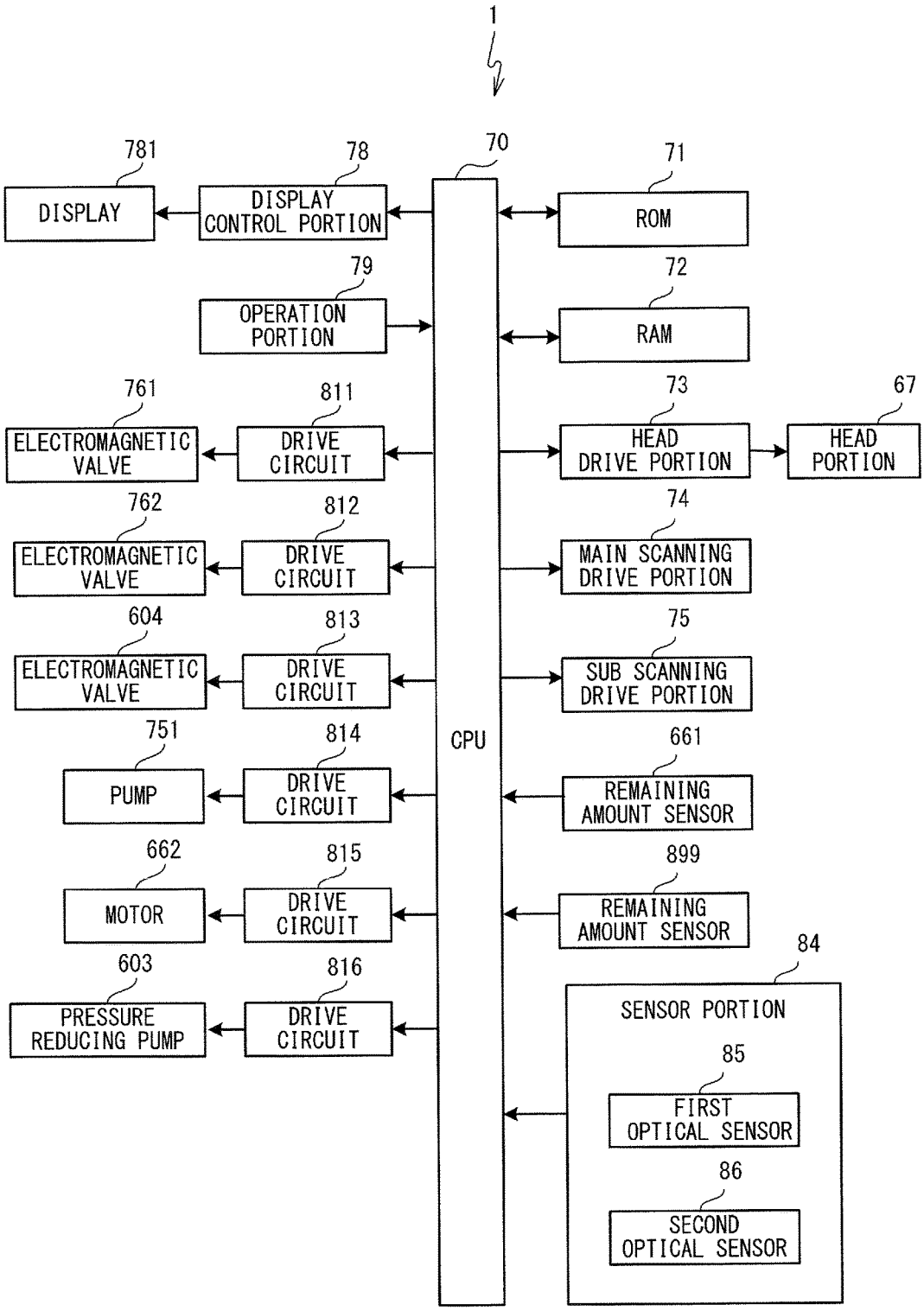
FIG. 7 is a diagram showing an electrical configuration of the printer.

An electrical configuration of the printer 1 will be explained with reference to FIG. 7. The printer 1 is provided with the CPU 70 that controls the printer 1. The CPU 70 is electrically connected to a ROM 71, a RAM 72, a head drive portion 73, a main scanning drive portion 74, a sub scanning drive portion 75, the remaining amount sensor 661, the remaining amount sensor 899, a display control portion 78, the operation portion 79, the sensor portion 84, and drive circuits 811 to 816.

A control program for the CPU 70 to control operations of the printer 1, initial values, and the like are stored in the ROM 71. Various types of data used by the control program are temporarily stored in the RAM 72. The head drive portion 73 is electrically connected to the head portion 67 that ejects the ink 68, drives the piezoelectric elements provided in each of ejection channels of the head portion 67, and causes the ink 68 to be ejected from the nozzles.

The main scanning drive portion 74 includes the drive motor 19 (refer to FIG. 1) and moves the carriage 20 in the main scanning direction. The sub scanning drive portion 45 drives the platen drive mechanism 6 (refer to FIG. 1) and moves the platen 5 (refer to FIG. 1) in the sub scanning direction.

The CPU 70 controls the display control portion 78 and causes images to be displayed on the display 781. The operation portion 79 outputs, to the CPU 70, a signal based on an operation by a user. The sensor portion 84 outputs, to the CPU 70, the signals of the first optical sensor 85 and the second optical sensor 86.

The CPU 70 controls the electromagnetic valve 761 via the drive circuit 811 and opens and closes the flow path 720 (refer to FIG. 2 and FIG. 3). The CPU 70 controls the electromagnetic valve 762 via the drive circuit 812 and opens and closes the circulation flow path 731 (refer to FIG. 3). The CPU 70 controls the electromagnetic valve 604 via the drive circuit 813 and opens and closes the channel 608 (refer to FIG. 3). The CPU 70 causes the pump 751 to operate via the drive circuit 814. The CPU 70 drives the motor 662 via the drive circuit 815. The CPU 70 drives the pressure reducing pump 603 via the drive circuit 816.

Main processing executed by the CPU 70 will be explained with reference to FIG. 8. When a power source of the printer 1 is switched on, for example, the CPU 70 reads out a main processing program from the ROM 71 and deploys the main processing program to the RAM 72. The CPU 70 executes the main processing in accordance with the program.

Figure 8:
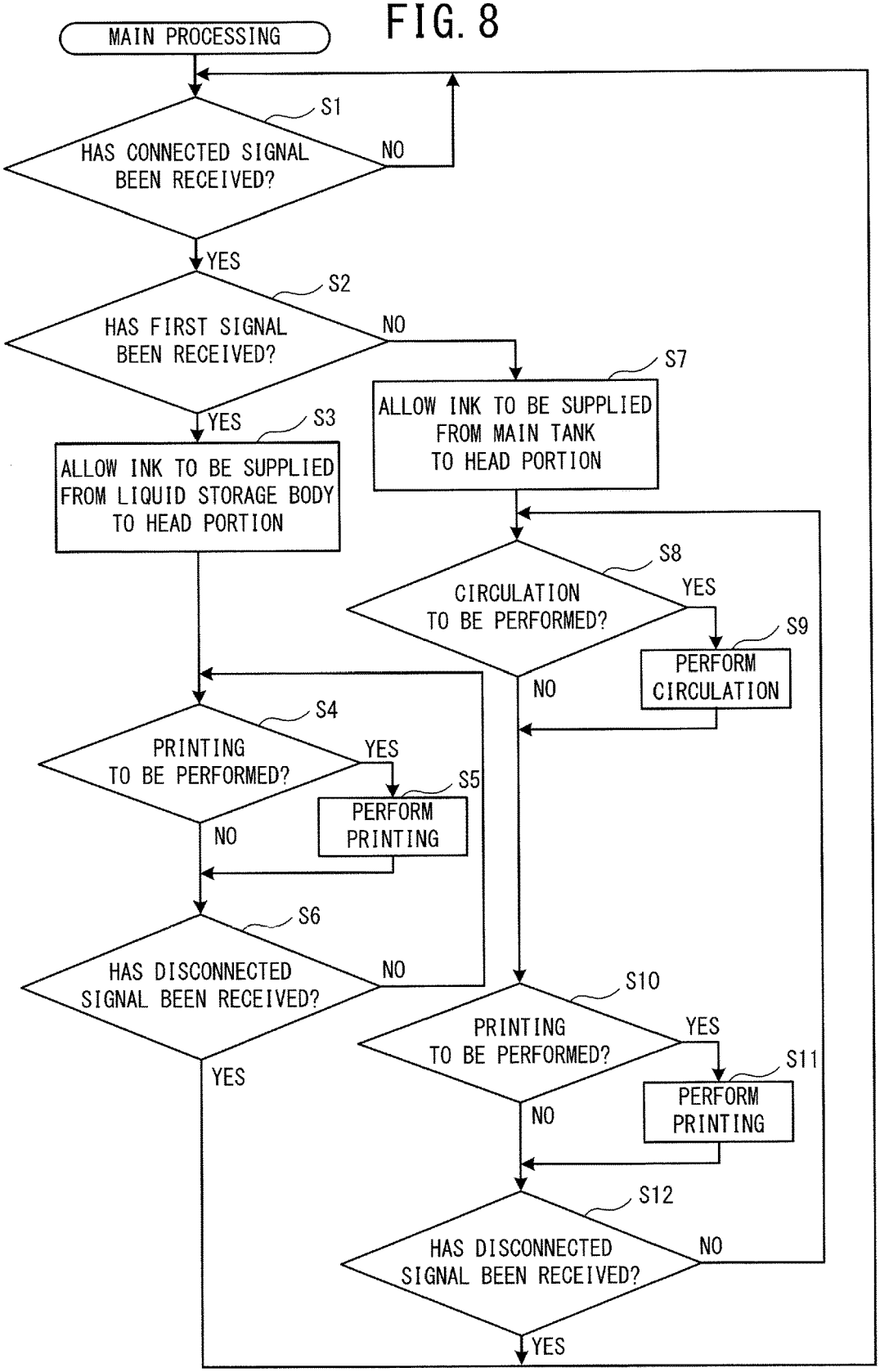
FIG. 8 is a flowchart of main processing.

As shown in FIG. 8, the CPU 70 determines whether the connected signal has been received (step S1). As described above, when the cartridge 3 or the connection module 40 is mounted in the mounting portion 8 (refer to FIG. 5 and FIG. 6), the connected signal is outputted from the second optical sensor 86. When the cartridge 3 and the connection module 40 are not mounted in the mounting portion 8 (refer to FIG. 4), the disconnected signal is outputted from the second optical sensor 86. Thus, the CPU 70 determines whether the cartridge 3 or the connection module 40 has been mounted in the mounting portion 8, by performing the processing at step S1. When the CPU 70 receives the disconnected signal, the CPU 70 determines that the connected signal has not been received (no at step S1) and repeats the processing at step S1.

When the CPU 70 has received the connected signal (yes at step S1), the CPU 70 determines whether the first signal has been received (step S2). When the cartridge 3 is mounted in the mounting portion 8 (refer to FIG. 5), the first signal is outputted from the first optical sensor 85. When the connection module 40 is mounted in the mounting portion 8 (refer to FIG. 6), the second signal is outputted from the first optical sensor 85. Thus, the CPU 70 determines which of the cartridge 3 and the connection module 40 is mounted in the mounting portion 8, by performing the processing at step S2.

When the CPU 70 has received the first signal (yes at step S2), the CPU 70 allows the ink 68 to be supplied to the head portion 67 from the liquid storage body 301 of the cartridge 3 (step S3). In the present embodiment, as an example, the CPU 70 opens the electromagnetic valve 761 (refer to FIG. 2). In this way, the ink 68 can be supplied to the head portion 67 from the liquid storage body 301 of the cartridge 3. In the present embodiment, when the electromagnetic valve 761 is opened, due to a water head difference between the ink 68 inside the cartridge 3, and the ink 68 inside the sub pouch 97, the ink 68 is filled into the sub pouch 97 from the cartridge 3 (refer to an arrow 891 in FIG. 2). The ink 68 filled into the sub pouch 97 is ejected from the head portion 67 when printing is performed. Note that, in the present embodiment, as an example, the cartridge 3 is disposed in a position higher than the sub pouch 97.

The CPU 70 determines whether to perform the printing (step S4). For example, when the CPU 70 has received a command to perform the printing, from an external device (not shown in the drawings) that is connected to the printer 1, the CPU 70 determines that the printing is to be performed (yes at step S4).

When the printing is not to be performed (no at step S4), the CPU 70 performs processing at step S6 to be described later. When the printing is to be performed (yes at step S4), the CPU 70 performs the printing (step S5). At step S5, the CPU 70 performs the printing by controlling the head portion 67 and ejecting the ink 68. By the ink 68 being ejected from the head portion 67, the ink 68 flows from the sub pouch 97 to the head portion 67 (refer to an arrow 892 in FIG. 2). The CPU 70 moves the carriage 20 (refer to FIG. 1) in the main scanning direction and moves the platen 5 (refer to FIG. 1) in the sub scanning direction. Note that, when the printing is performed, the electromagnetic valve 761 may be closed.

After performing the processing at step S5, the CPU 70 determines whether the disconnected signal has been received (step S6). When the cartridge 3 has been removed from the mounting portion 8, the disconnected signal is outputted from the second optical sensor 86. When the disconnected signal has not been received (no at step S6), the CPU 70 returns the processing to step S4. When the disconnected signal has been received (yes at step S6), the CPU 70 returns the processing to step S1.

As described above, when the connection module 40 is mounted in the mounting portion 8 (refer to FIG. 6), the second signal is outputted from the first optical sensor 85. In this case, at step S2, the CPU 70 determines that the first signal has not been received (no at step S2) and allows the ink 68 to be supplied to the head portion 67 from the main tank 65 (step S7). In the present embodiment, as an example, the CPU 70 opens the electromagnetic valve 761 and allows the ink 68 to be supplied to the head portion 67 from the main tank 65. Note that the electromagnetic valve 762 may be closed. In a state in which the electromagnetic valve 761 is open, if the pump 751 operates in accordance with the control of the CPU 70, the ink 68 stored in the main tank 65 is filled into the sub pouch 97 via the connection module 40 (refer to an arrow 893 shown in FIG. 3). The ink 68 filled into the sub pouch 97 is ejected from the head portion 67 when printing is performed.

It should be noted that the timing of filling the sub pouch 97 with the ink 68 need not necessarily be when the processing at step S7 is performed. For example, the CPU 70 may detect the output of the remaining amount sensor 899 and may operate the pump 751 and fill the sub pouch 97 with the ink 68 from the main tank 65 when the remaining amount of the ink 68 inside the sub pouch 97 is equal to or lower than a predetermined value.

The CPU 70 determines whether to perform the circulation of the ink 68 (step S8). For example, the CPU 70 determines that the circulation of the ink 68 is to be performed after a predetermined time period (2 hours, for example) has elapsed since performing a previous circulation of the ink 68.

Figure 9:
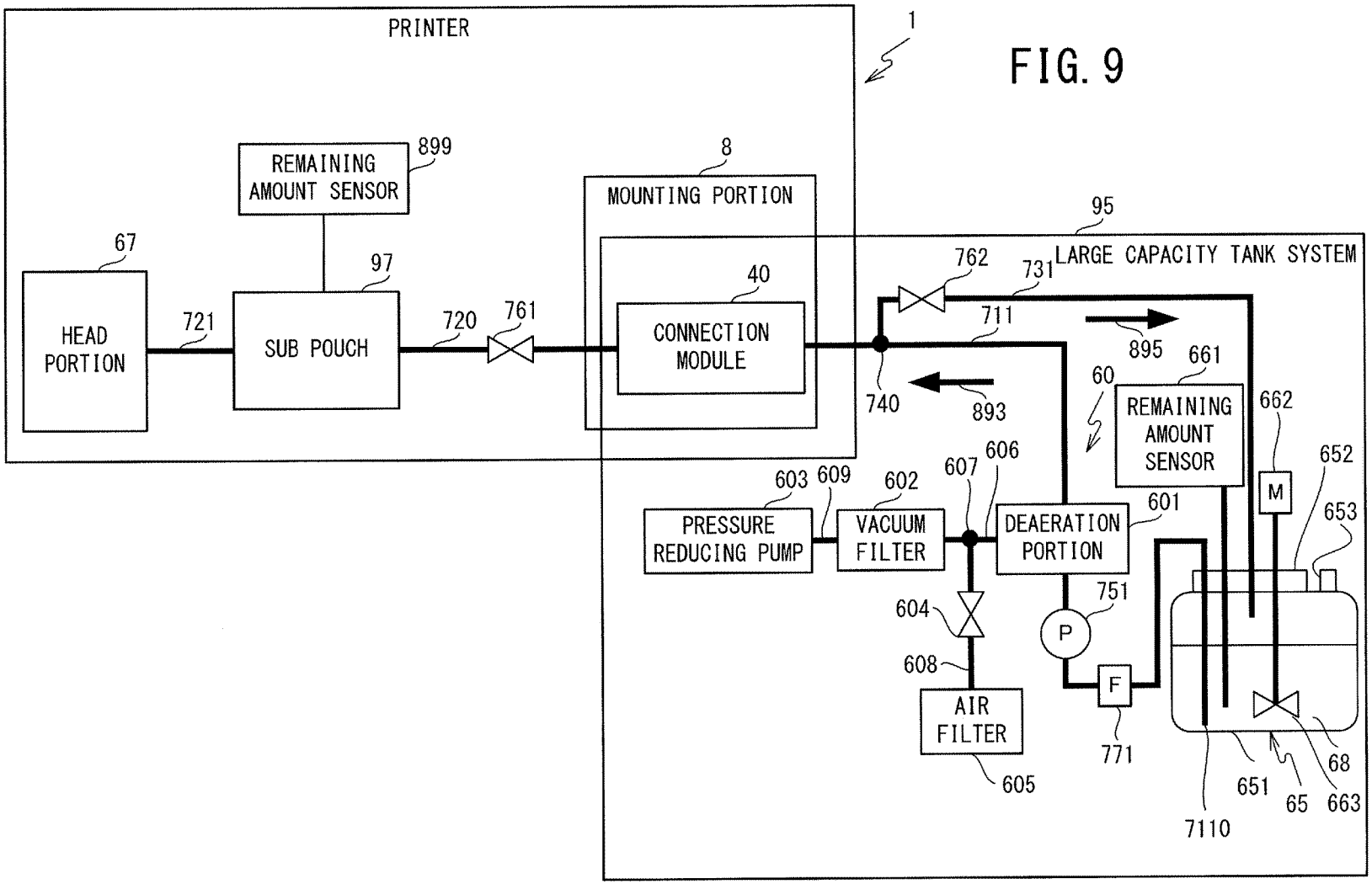
FIG. 9 is a diagram showing a state in which ink is circulated.

When the circulation of the ink 68 is not to be performed (no at step S8), the CPU 70 performs processing at step S10 to be described later. When the circulation of the ink 68 is to be performed (yes at step S8), the CPU 70 performs the circulation of the ink 68 (step S9). In other words, the CPU 70 performs the circulation of the ink 68 (step S9) in a state in which the connected signal has been received (yes at step S1) and the first signal has not been received (no at step S2). As shown in FIG. 9, the CPU 70 closes the electromagnetic valve 761 and opens the electromagnetic valve 762. The CPU 70 operates the pump 751. In this way, the ink 68 is sucked up from the main tank 65, and then returns to the main tank 65 via the supply flow path 711 and the circulation flow path 731 (refer to arrows 895 shown in FIG. 9). Note that the circulation of the ink 68 may also be performed before the processing at step S7 is performed, in a similar manner to step S8.

As shown in FIG. 8, the CPU 70 determines whether the printing is to be performed (step S10). For example, when the CPU 70 has received the command to perform the printing, from the external device (not shown in the drawings) that is connected to the printer 1, the CPU 70 determines that the printing is to be performed (yes at step S10).

When the printing is not to be performed (no at step S10), the CPU 70 performs processing at step S12 to be described later. When the printing is to be performed (yes at step S10), the CPU 70 performs the printing (step S11). The operation to perform the printing is the same as at step S5. By the ink 68 being ejected from the head portion 67, the ink 68 flows from the sub pouch 97 to the head portion 67 (refer to an arrow 894 shown in FIG. 3).

After performing the processing at step S11, the CPU 70 determines whether the disconnected signal has been received (step S12). When the connection module 40 has been removed from the mounting portion 8, the disconnected signal is outputted by the second optical sensor 86. When the disconnected signal has not been received (no at step S12), the CPU 70 returns the processing to step S8. When the disconnected signal has been received (yes at step S12), the CPU 70 returns the processing to step S1.

The printer 1 according to the present embodiment is configured as described above. The needle 83 of the printer 1 of the present embodiment can connect the liquid storage body 301 of the cartridge 3 to the head portion 67 and can connect the main tank 65 to the head portion 67 via the connection module 40. Thus, when the amount of the ink 68 to be used is small, in comparison to when the main tank 65 is used, by connecting and using the liquid storage body 301 of the cartridge 3 (refer to FIG. 2 and FIG. 5), a possibility can be reduced that the ink 68 will not be fully used up within a consumption time limit. As a result, costs of disposal of the ink 68 can be reduced. Further, when the amount of the ink 68 to be used is large, by connecting the main tank 65 (refer to FIG. 3 and FIG. 6), operating costs can be reduced. The main tank 65 and the cartridge 3 can therefore be selected depending on a usage amount of the ink 68, and user convenience is improved.

Note that the operating costs include labor costs, the cost of the ink 68, and so on. When the main tank 65 is used, for example, in comparison to frequently replacing the cartridge 3, the frequency of replacing the main tank 65 is low. Thus, the labor costs required for performing the replacement can be reduced. Further, a unit price of the ink 68 of the large capacity main tank 65 tends to be lower than that of the ink 68 of the small capacity liquid storage body 301. As a result, when the main tank 65 is used, the costs of the ink 68 can be reduced.

When the first signal has been received from the sensor portion 84 (yes at step S2), the CPU 70 performs control such that the ink 68 can be supplied from the liquid storage body 301 of the cartridge 3 to the head portion 67 (step S3). When the second signal has been received from the sensor portion 84 (no at step S2), the CPU 70 performs control such that the ink 68 can be supplied from the main tank 65 to the head portion 67 (step S7). In this case, when the needle 83 is connected to the liquid storage body 301, the ink 68 can automatically be supplied from the liquid storage body 301 to the head portion 67. Further, when the needle 83 is connected to the main tank 65, the ink 68 can automatically be supplied from the main tank 65 to the head portion 67. The ink 68 can be automatically supplied to the head portion 67 from the liquid storage body 301 or the main tank 65, and there is thus no need for the user to perform an operation to manually allow the ink 68 to be supplied. As a result, user convenience is improved.

When the second signal is received from the sensor portion 84 (no at step S2), the circulation flow path 731 is used and the circulation of the ink 68 stored in the main tank 65 is performed (step S9). In other words, the printer 1 is provided with the circulation flow path 731 that is a circulation portion to circulate the ink 68 stored in the main tank 65 when the second signal has been received from the sensor portion 84. Therefore, the ink 68 stored in the main tank 65 is circulated, and a problem of the sedimentation of the components of the ink 68 is resolved. As a result, a possibility can be reduced of a deterioration in the print quality resulting from the sedimentation of the components of the ink 68.

The pump 751 that delivers the ink 68 is provided in the supply flow path 711 between the main tank 65 and the connection module 40 (refer to FIG. 3). Here, the capacity of the main tank 65 is greater than that of the liquid storage body 301, and the main tank 65 therefore becomes heavy. Therefore, from the point of view of convenience when moving the main tank 65, and stability when installing the main tank 65, it is likely that the main tank 65 is placed lower than the printer 1. When the main tank 65 is placed lower than the printer 1, it becomes difficult to deliver the ink 68 stored in the main tank 65, due to the water head difference. In the present embodiment, since the pump 751 is provided, the ink 68 can be more reliably delivered from the main tank 65 in comparison to a case in which the pump 751 is not provided. As a result, the possibility can be reduced of a deterioration in the print quality resulting from a failure to deliver the ink 68. Printing can therefore be performed with a favorable print quality, and user convenience is improved.

The deaeration portion 601 that reduces the air bubbles included in the ink 68 is provided in the supply flow path 711 between the main tank 65 and the connection module 40 (refer to FIG. 3). Therefore, the amount of air, such as air bubbles, included in the ink 68 is reduced. As a result, the possibility can be reduced of a deterioration in the print quality resulting from the influence of air included in the ink 68. Printing can therefore be performed with a favorable print quality, and user convenience is improved.

It should be noted that, although not shown in the drawings, when the second signal is received from the sensor portion 84, the CPU 70 can perform control to perform deaeration using the deaeration portion 601. In other words, the deaeration portion 601 is a member that can perform deaeration when the second signal is received from the sensor portion 84. Further, the CPU 70 can allow the pump 751 to deliver the ink 68 when the second signal is received from the sensor portion 84. In other words, the pump 751 is a member that can deliver the ink 68 when the second signal is received from the sensor portion 84.

The present disclosure is not limited to the above-described embodiment, and various modifications are possible. For example, the ink 68 is delivered by the pump 751, but the configuration is not limited to this example. For example, instead of the pump 751, the ink 68 may be delivered as a result of the water head difference between the main tank 65 and the sub pouch 97. The pump 751 need not necessarily be provided. The deaeration module 60 need not necessarily be provided. The circulation flow path 731 need not necessarily be provided. The sub pouch 97 need not necessarily be provided. It is sufficient that the electromagnetic valves 604, 761, and 762 be opening and closing portions that open and close the flow paths, and electromagnetic valves 604, 761, and 762 may be other types of valve.

The liquid storage body 301 and the main tank 65 are connected to the head portion 67 via the needle 83, but the configuration is not limited to this example. For example, rather than the needle 83, the liquid storage body 301 and the main tank 65 may be connected to the head portion 67 using another connection portion.

The connection point 740 (refer to FIG. 2 and FIG. 3) between the supply flow path 711 and the circulation flow path 731 is provided on the outside of the connection module 40 but may be provided on the inside of the connection module 40. In this case, the supply flow path 711 and the circulation flow path 731 extend from the connection module 40 to the main tank 65.

The cartridge 3 and the connection module 40 may be disposed in the different placement portions 120 and may be switchable between a case in which the ink 68 is supplied to one of the head portions 67 from the cartridge 3, and a case in which the ink 68 is supplied from the main tank 65 via the connection module 40. Below, this modified example will be explained with reference to FIG. 10.

Figure 10:
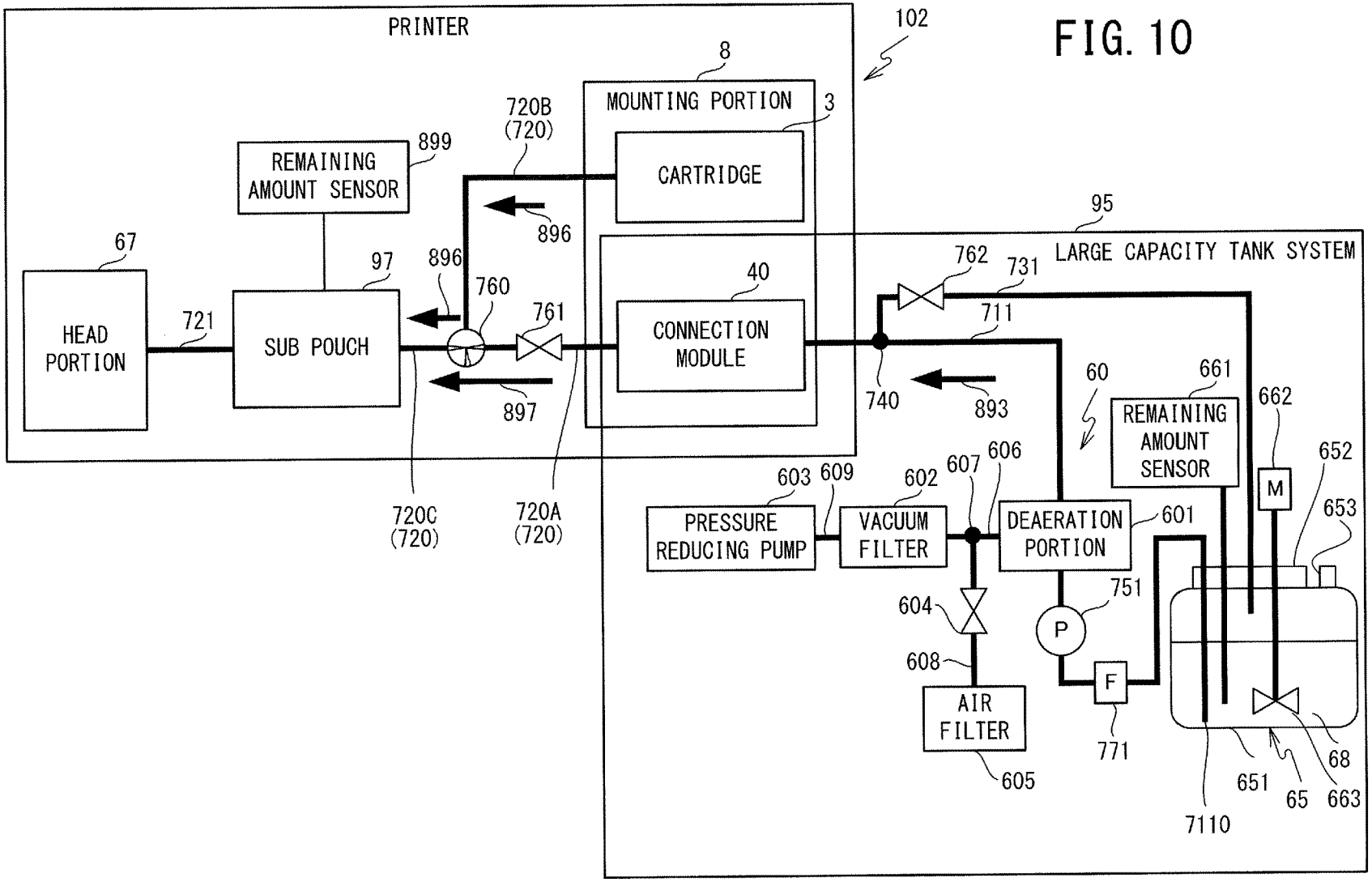
FIG. 10 is a diagram showing flow paths of ink in a printer according to a modified example.

FIG. 10 shows flow paths of a printer 102 according to the modified example. In FIG. 10, the same reference numerals are assigned to the same configuration as the above-described embodiment and a detailed explanation of the same configuration is omitted. In the printer 102, the cartridge 3 and the connection module 40 are disposed in the different placement portions 120 (refer to FIG. 1). Then, the ink 68 is supplied to one of the head portions 67 from the cartridge 3 or the connection module 40.

As shown in FIG. 10, the printer 102 is provided with a switching portion 760 that switches the flow path of the ink 68. The switching portion 760 is a three-way valve or the like. The switching portion 760 is provided in the flow path 720. Of the flow path 720, a flow path between the switching portion 760 and the connection module 40 is referred to as a flow path 720A, and a flow path between the switching portion 760 and the cartridge 3 is referred to as a flow path 720B. Of the flow path 720, a flow path between the switching portion 760 and the sub pouch 97 is referred to as a flow path 720C. The electromagnetic valve 761 is provided in the flow path 720A. The switching portion 760 switches the flow path along which the ink 68 flows between the flow path 720A and the flow path 720B, in accordance with the control of the CPU 70.

For example, an explanation will be made of a case in which the cartridge 3 is mounted in the mounting portion 8 and the connection module 40 is not mounted in the mounting portion 8. In this case, the first signal is outputted from the sensor portion 84 of the placement portion 120 in which the cartridge 3 is mounted. When the first signal is received (yes at step S2 in FIG. 8), in the processing at step S3, the CPU 70 controls the switching portion 760 and switches the flow path such that the ink 68 flows from the flow path 720B to the flow path 720C. In this way, the ink 68 flows to the sub pouch 97 from the liquid storage body 301 of the cartridge 3, via the flow path 720B and the flow path 720C (refer to arrows 896 shown in FIG. 10). Note that the electromagnetic valve 761 is in a closed state.

A case will be explained in which the connection module 40 is mounted in the mounting portion 8 and the cartridge 3 is not mounted in the mounting portion 8. In this case, the second signal is outputted from the sensor portion 84 of the placement portion 120 in which the connection module 40 is mounted. When the second signal is received (no at step S2 in FIG. 8), in the processing at step S7, the CPU 70 controls the switching portion 760 and switches the flow path such that the ink 68 flows from the flow path 720A to the flow path 720C. Further, the CPU 70 opens the electromagnetic valve 761. In this way, the ink 68 stored in the main tank 65 flows to the sub pouch 97, via the flow path 720A and the flow path 720C (refer to an arrow 897 shown in FIG. 10).

In the present modified example, the switching portion 760 is provided that switches the flow path of the ink 68 between the case in which the first signal is received from the sensor portion 84 and the case in which the second signal is received from the sensor portion 84. As a result, the flow path of the ink 68 is automatically switched between the case in which the liquid storage body 301 of the cartridge 3 is connected to the needle 83 and the case in which the main tank 65 is connected to the needle 83. Thus, the user does not need to manually switch the flow path. As a result, the user convenience is improved.

Note that the switching portion 760 automatically switches the flow path, but the configuration is not limited to this example. For example, the switching portion 760 may be locked such that the flow path cannot be switched, and the lock may be released when the CPU 70 receives the first signal or the second signal. Then, the user may manually operate the switching portion 760 and switch the flow path. The switching portion 760 need not necessarily be locked, and the user may manually operate the switching portion 760 and switch the flow path.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a head configured to eject ink;

a flow path configured to supply the ink to the head; and a connector provided on an end portion of the flow path opposite to the head side, and configured to be connected to a first storage or a joint component, the connector being configured to connect the first storage to the head, and configured to connect the second storage to the head via the joint component, the first storage storing the ink, and the second storage storing a greater amount of the ink than the first storage.

2. The printer according to claim 1, wherein the first storage is a cartridge provided with a liquid storage body inside the cartridge, the liquid storage body storing the ink.

3. The printer according to claim 1, wherein the second storage is a main tank provided with a container that stores the ink.

4. The printer according to claim 1, further comprising:

a sensor configured to output a first signal and a second signal, the first signal being outputted when the first storage is connected to the connector, and the second signal being outputted when the second storage is connected to the connector;

a processor; and a memory storing computer-readable instructions which, when executed by the processor, perform the processes including:

supplying the ink to the head from the first storage when the first signal is received from the sensor; and supplying the ink to the head from the second storage when the second signal is received from the sensor.

5. The printer according to claim 4, further comprising:

a switching valve configured to switch a flow path of the ink between a case in which the first signal is received from the sensor and a case in which the second signal is received from the sensor.

6. The printer according to claim 4, further comprising:

a circulation flow path connected to the second storage and a flow path between the second storage and the joint component, wherein the computer-readable instructions, when executed by the processor, further perform the processes including:

circulating the ink stored in the second storage via the circulation flow path when the second signal is received from the sensor.

7. The printer according to claim 1, further comprising:

a liquid delivery portion provided in a flow path between the second storage and the joint component, and configured to deliver the ink.

8. The printer according to claim 7, wherein:

the liquid delivery portion includes:

a pump provided in the flow path between the second storage and the joint component, and configured to deliver the ink.

9. The printer according to claim 1, further comprising:

a deaeration portion provided in a flow path between the second storage and the joint component, and configured to reduce air included in the ink.

10. The printer according to claim 9, wherein:

the deaeration portion includes:

a vacuum filter connected to the flow path via first channel; and a pump connected to the vacuum filter via second channel and configured to depressurize the first channel.

11. The printer according to claim 9, wherein:

the deaeration portion further includes:

an air filter connected to the first channel via third channel, and configured to eliminate foreign matter included in air flowing into the first channel.

* * * * *